US005871108A

United States Patent [19]

White

[11] Patent Number: 5,871,108

[45] **Date of Patent: *Feb. 16, 1999**

[54] REAR LOADING MERCHANDISE SHELVING ARRANGEMENT

[75] Inventor: Marco J. White, Marietta, Ga.

[73] Assignee: The Coca-Cola Company, Atlanta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 758,102

[22] Filed: Nov. 29, 1996

[51] Int. Cl.[6] ..... A47B 43/00

[52] U.S. Cl. ..... 211/186; 211/151; 108/108; 312/283

[58] Field of Search ..... 211/186, 187, 211/151, 162, 59.2; 108/108, 107, 106, 189; 312/283, 287, 111, 211, 249.8

[56] References Cited

U.S. PATENT DOCUMENTS

| | | | |
|---|---|---|---|
| 1,010,950 | 12/1911 | Prather . | |
| 1,749,937 | 3/1930 | Dettenborn . | |
| 2,098,828 | 11/1937 | Ludwick . | |
| 3,111,915 | 11/1963 | Gray . | |
| 3,316,863 | 5/1967 | Zock | 108/108 |
| 3,475,070 | 10/1969 | Hoshall | 312/283 X |
| 3,797,842 | 3/1974 | Swick, Jr. et al. | 211/186 X |
| 4,067,265 | 1/1978 | Watson . | |
| 4,299,327 | 11/1981 | Thauer | 211/186 |
| 4,491,375 | 1/1985 | Ugalde . | |
| 4,807,765 | 2/1989 | Brown et al. . | |
| 4,886,171 | 12/1989 | Spamer . | |
| 4,898,283 | 2/1990 | Kingsford . | |
| 4,919,282 | 4/1990 | Duff et al. . | |
| 4,991,725 | 2/1991 | Welsch et al. . | |
| 5,062,535 | 11/1991 | Potter . | |
| 5,072,838 | 12/1991 | Price, Jr. et al. . | |
| 5,160,051 | 11/1992 | Bustos . | |
| 5,197,610 | 3/1993 | Bustos . | |
| 5,201,429 | 4/1993 | Hikosaka et al. . | |
| 5,205,421 | 4/1993 | Bustos . | |
| 5,240,124 | 8/1993 | Buday . | |
| 5,341,944 | 8/1994 | Latino . | |
| 5,417,333 | 5/1995 | Flum . | |
| 5,439,122 | 8/1995 | Ramsay . | |
| 5,496,000 | 3/1996 | Bustos . | |

FOREIGN PATENT DOCUMENTS

| | | | |
|---|---|---|---|
| 1 093736 | 5/1955 | France . | |
| 1410844 | 8/1965 | France | 211/186 |
| 1 578786 | 7/1969 | France . | |
| 2329234 | 5/1977 | France | 108/108 |
| 3 204882A1 | 8/1983 | Germany . | |
| A 9200353 | 2/1992 | Netherlands . | |
| 307587 | 8/1955 | Switzerland | 108/108 |

*Primary Examiner*—Blair M. Johnson

[57] ABSTRACT

A merchandise display shelving arrangement incorporates a first, gondola-type shelving unit with shelves intended to be loaded from the rear. The shelves may be inclined to promote gravity feeding of merchandise toward the front of the shelves. A second shelving unit is readily movable between a position in which it backs up to the first shelving unit and obstructs access to the rear of the shelves and another position in which it is spaced from the first shelving unit to create an aisle affording access to the rear of the shelves to facilitate loading of merchandise onto the shelves.

1 Claim, 3 Drawing Sheets

REAR LOADING MERCHANDISE SHELVING ARRANGEMENT

BACKGROUND OF THE INVENTION

The present invention relates to a shelving arrangement. More specifically, the present invention relates to a merchandise display shelving arrangement with gravity feed shelves which are conveniently loaded from the rear ends of the shelves.

Conventional merchandise display shelving arrangements with shelves at several levels, like the "gondola" shelving commonly used in grocery stores, are relatively heavy and are designed to support relatively heavy merchandise loads. In a grocery store, gondola shelving units are conventionally placed back-to-back. Because of their weight, these shelving units are not readily movable and do not offer access to the displayed merchandise from the rear ends of the shelves.

Because some merchandise, packaged foods, for example, degrade over time, it is advantageous to position the fresher merchandise articles at the rear of the shelves. In this way, the older articles, at the front of the shelves, are more likely to sell first, and an accumulation of out-of-date merchandise is less likely to occur.

Stocking conventional grocery shelving so that the fresher merchandise articles are at the rear of the shelves is troublesome when the shelves are not accessible from the rear. Frequently, articles at the front of the shelves must be moved aside, or removed from the shelves, in order to allow placement of the fresher articles at the rear. If the rear of the shelving were accessible, adding fresh merchandise at the rear ends of the shelves would be considerably more convenient and efficient.

In some stores, such as the "warehouse type" retail stores, the merchandise shelving employs shelves which are inclined downwardly from rear to front so that the weight of the displayed articles causes them to move toward the front ends of the shelves. Typically, the gravity-feed shelving units are located against walls at the periphery of the store. The shelves are stocked from a room or an aisle behind the walls.

In central regions of stores, access to the rear of stationary shelving units is not easily provided. Consequently, the favorable attributes of gravity-feed shelving, or other shelving which is loaded from the rear, are not realized in these regions of a store which are away from the store periphery.

In view of the shortcomings of known merchandise display shelving arrangements, a shelving arrangement which allows easy access to the rear of the shelves, and which could be placed in a central region of a store, would be most welcome.

OBJECTS AND SUMMARY OF THE INVENTION

Accordingly, it is a primary object of the present invention to provide a merchandise display shelving arrangement which facilitates loading of the shelves from the rear and which can be placed centrally within a store.

It is another object of the present invention to provide a centrally located rear loading merchandise display shelving arrangement in which the shelves are inclined downwardly from rear to front to afford gravity-influenced movement of merchandise toward the front of the shelves.

It is yet another object of the present invention to provide a rear loading merchandise display shelving arrangement in which at least one of the shelving units is movable to permit the formation of an aisle between the shelving units which affords access to the rear of the shelves.

It is yet another object of the present invention to provide a method of rotating merchandise to encourage sale of older merchandise first in a merchandise display shelving arrangement.

The foregoing objects of the present invention and others as well are fulfilled by providing a merchandise display shelving arrangement comprising: first and second shelving units each including (1) an upright support assembly and (2) a plurality of shelves carried on and extending forwardly from the upright support assembly, at least one of the shelving units also including openings in the upright support assembly affording access to rear ends of the shelves for loading merchandise onto the shelves; and means permitting relative movement of the shelving units between a position in which rear sides of the shelving units are disposed in confronting relation and another position in which the rear sides of the shelving units shelving units are separated to form an aisle between the shelving units which facilitates placement of merchandise onto rear ends of at least one of the shelving units.

The objects of the present invention are also fulfilled by providing a method of rotating merchandise to encourage sale of older merchandise first in a merchandise display shelving arrangement, comprising the steps of: providing first and second shelving units each including (1) an upright support assembly and (2) a plurality of shelves carried on and extending forwardly from the upright support assembly, at least one of the shelving units also including openings in the upright support assembly affording access to rear ends of the shelves for loading merchandise onto the shelves; moving the shelving units between a position in which rear sides of the shelving units are disposed in confronting relation and another position in which the rear sides of the shelving units shelving units are separated to form an aisle between the shelving units which facilitates placement of merchandise onto rear ends of at least one of the shelving units; and loading at least one of the shelving units from the rear side with fresh merchandise from the aisle.

The objects of the present invention are also fulfilled by providing a merchandise display shelving arrangement comprising: a stationary shelving unit including (1) a first upright support assembly, (2) a plurality of shelves carried on and extending forwardly from the first upright support assembly and (3) openings in the first upright support assembly affording access to rear ends of the shelves for loading merchandise onto the shelves; a movable shelving unit including (1) a base provided with means facilitating movement of the movable shelving unit over a support surface, (2) a second upright support assembly carried on the base and (3) a plurality of merchandise supports carried on the second upright support assembly; and wherein the second upright support assembly is of a size and shape so as to obstruct access to the openings in the first upright support assembly when the movable shelving unit is positioned with its rear side in confronting relation with the rear side of the stationary shelving unit.

The present invention further includes means for immobilizing at least one of the shelving units with its rear side in confronting relation with the rear side of the other shelving unit; the means for immobilizing may comprise at least one fastener for joining the shelving units to each other.

Also, in a preferred embodiment, the rear sides of the upright support assemblies are of substantially the same size and shape; one of the upright support assemblies may comprise a panel.

Still further, in a preferred embodiment, the upright support assembly of one of the shelving units may comprise an open arrangement of structural members. In another preferred embodiment, the upright support assembly of one of the shelving units may comprise a panel with openings permitting access to the rear of the shelves; a movable closure may be provided for at least one of the openings.

Still further, in a preferred embodiment, the shelves of at least one of the shelving units are inclined downwardly from rear to front to facilitate movement of merchandise toward the front ends of the shelves.

The detailed description which follows, to be read in conjunction with the accompanying drawings, will afford a comprehensive understanding of the present invention. However, it should be understood that the described preferred embodiments of the invention are illustrative only, since various modifications within the spirit and scope of the invention may become apparent to persons having ordinary skill in the art who have benefitted from this disclosure.

DETAILED DESCRIPTION OF PREFERRED EMBODIMENTS

Figure 1:
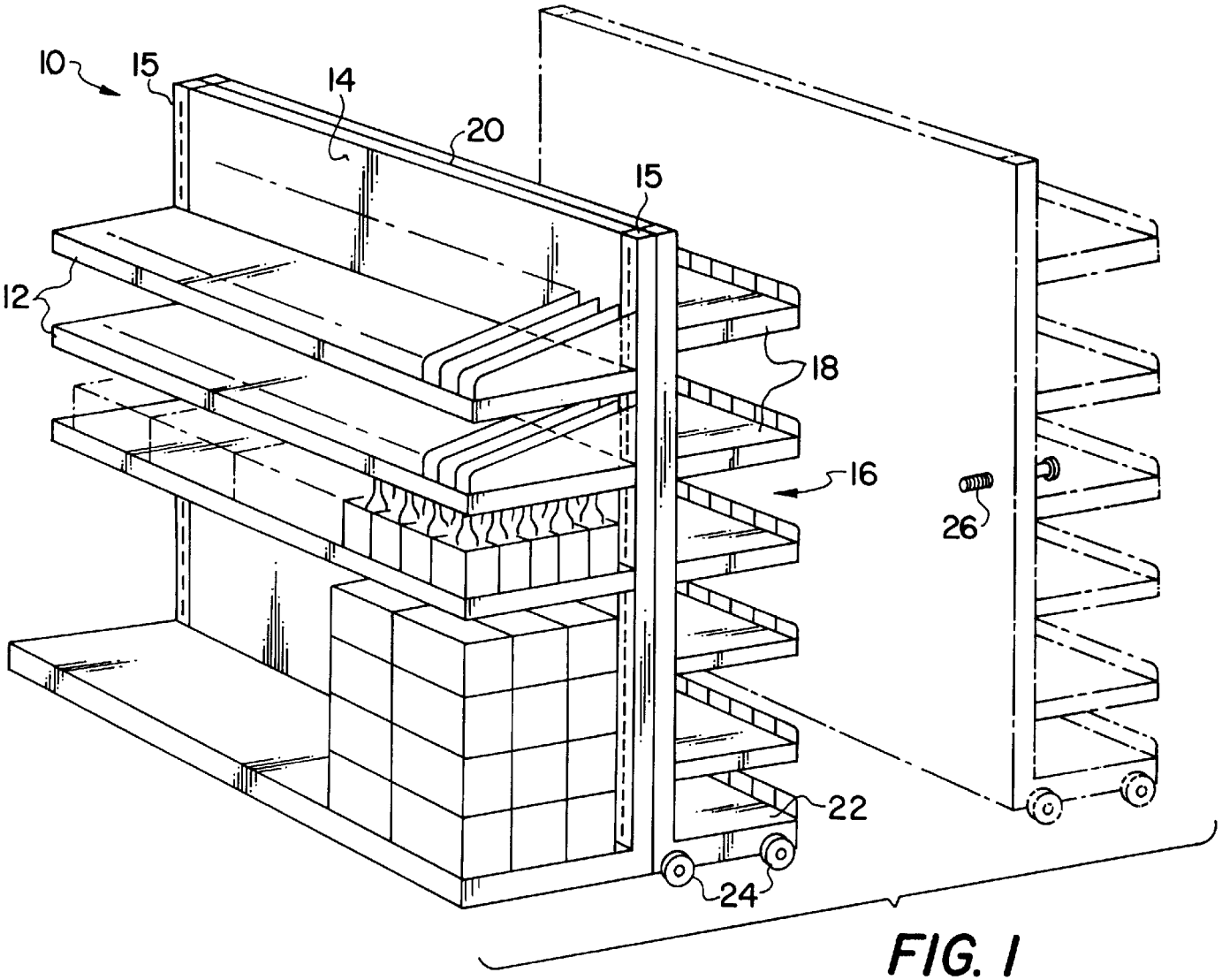
FIG. 1 is a perspective illustration of a merchandise shelving assembly of the present invention as viewed from the front of the stationary shelving unit.

As illustrated in FIG. 1 a merchandise display shelving arrangement according to the present invention includes a gondola-type shelving unit 10 provided with shelves 12 carried on an upright support assembly 14 which typically includes standards 15 with notches which permit placement of the shelves at different heights as desired. Shelving unit 10 is designed to carry relatively heavy merchandise loads, such as bottled and canned drinks, and is ordinarily positioned immovably within a retail establishment, such as a grocery store. As indicated by solid lines, another shelving unit 16 is positioned with its rear side confronting the rear side of shelving unit 10. The shelving unit 16 may be used for display of relatively light-weight merchandise, such as packaged snacks. As illustrated, the shelving unit 16, like the stationary shelving unit 10, includes shelves 18 carried on an upright support assembly 20, which may be a panel of substantially the same size and shape as the upright support assembly of the shelving unit 10. Alternatively, instead of shelves, the light-weight merchandise may be supported by brackets, rods, hooks or other devices (not illustrated) carried on the upright support assembly 20. The shelving unit 16 is provided with means to facilitate its movement which, as illustrated, may comprise a base 22 provided with wheels 24. By virtue of its relatively light weight and the wheeled base, the shelving unit 16 may be moved away from shelving unit 10 to the position, illustrated in phantom, in which an aisle is created between the shelving units. The aisle affords access to the rear sides of both shelving units and facilitates loading the shelves of at least one of the shelving units from the rear, as will be described. Fasteners, such as the illustrated bolts 26, which extend through the standards of movable shelving unit 16 and into the standards of stationary shelving unit 10, may be used to immobilize shelving unit 16 and maintain the shelving units in the solid line position. The bolts could include threads, or perhaps bayonet formations, which engage with complementary formations in the standards of shelving unit 10. Preferably, the heads of the bolts would be accessible from the front sides of shelving unit 16 at a height which is comfortable for personnel servicing the shelving units. Other means for immobilizing shelving unit 16, such as brakes for wheels 24, or wheel chocks, may also be employed.

Figure 2:
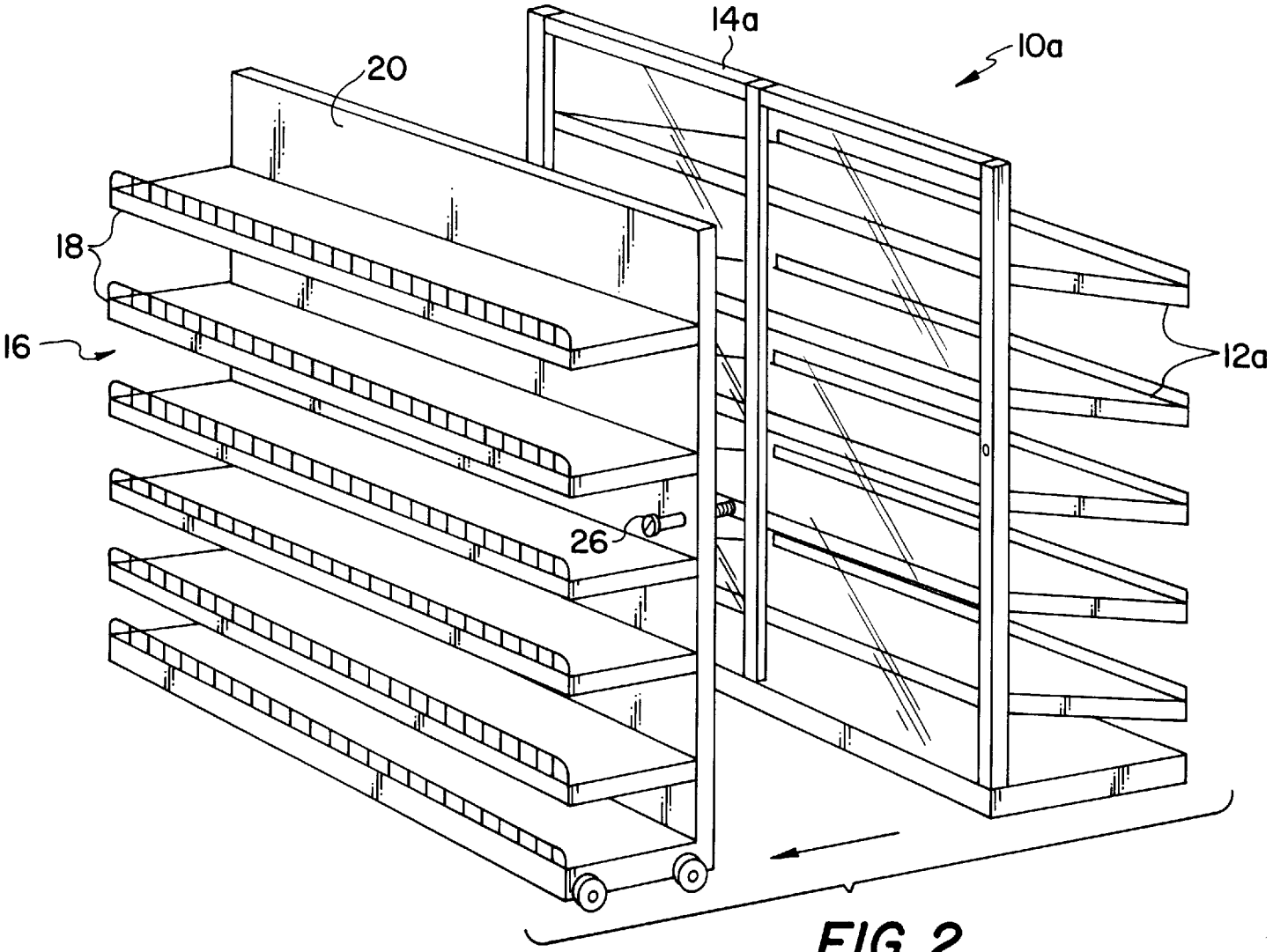
FIG. 2 is a perspective illustration of a merchandise shelving assembly of the present invention as viewed from the rear of the stationary shelving unit and showing an aisle formed between the stationary and movable shelving units.

As illustrated in FIG. 2, the upright support assembly 14*a* of gondola-type shelving unit 10*a* comprises a generally open arrangement of structural members affording openings to the rear of shelves 12*a* for the loading of merchandise. The rear side of the upright support assembly 20 for the movable shelving unit 16 may carry graphics which would be visible through the openings between the structural members of upright support assembly 14*a*. In this and other embodiments of the invention, the shelves of either or both of the shelving units may be inclined downwardly from rear to front, as shelves 12*a* are, to afford gravity-feeding of the merchandise toward the front of the shelves.

Figure 3:
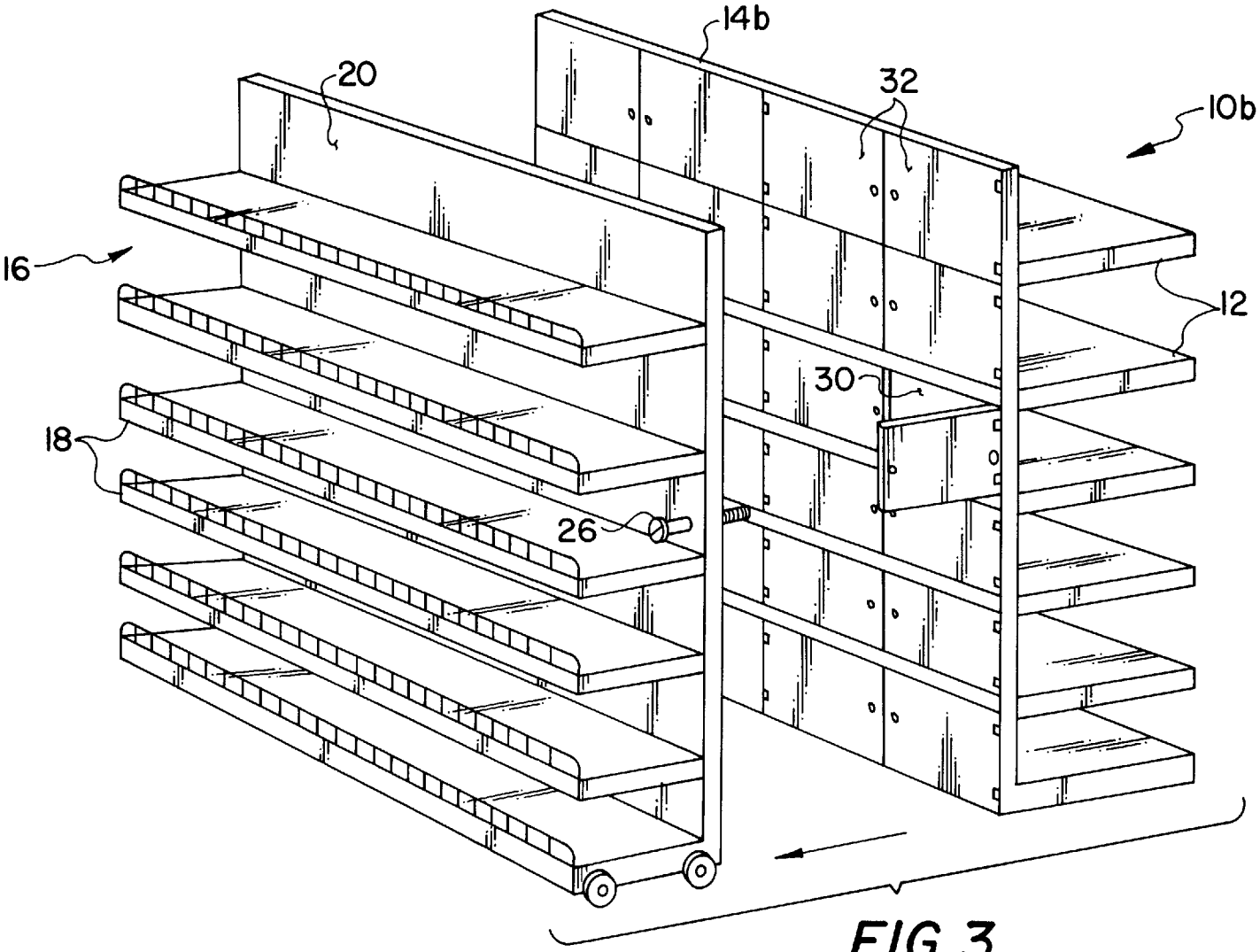
FIG. 3 is a perspective illustration of another embodiment of a merchandise shelving assembly of the present invention.

As illustrated in FIG. 3, the upright support assembly of gondola-type shelving unit 10*b* comprises a panel 14*b* with openings 30 affording access to the rear of the shelves 12. Closures, such as the hinged doors 32 may be provided for the openings.

The shelving arrangements described above may be located centrally within a retail establishment, such as a grocery store. When access to the rear of the shelving units is needed, or desirable, for loading of the shelves, the fasteners 26, 28 are disengaged, and the movable shelving unit is shifted away from the other shelving unit. From the aisle created between the shelving units, merchandise can be easily loaded onto the rear of the shelves. The movable shelving unit can then be shifted back to the position in which its rear side confronts the rear side of the other shelving unit to eliminate any intrusion into the customer aisles.

From the foregoing description of the invention, it will be apparent that the same may be varied in many ways. All such variations and modifications which would be obvious to persons of ordinary skill in the art are not to be regarded as departures from the spirit and scope of the invention and are intended to be included within the scope of the following claims.

What is claimed is:

1. A method of rotating merchandise to encourage sale of older merchandise first in a merchandise display shelving arrangement, comprising the steps of:

providing first and second shelving units each including (1) an upright support assembly and (2) a plurality of shelves carried on and extending forwardly from the upright support assembly, at least one of the shelving units also including openings in the upright support assembly affording access to rear ends of the shelves for loading merchandise onto the shelves;

moving the shelving units between a position in which rear sides of the shelving units are disposed in confronting relation and wherein access to the rear end of at least one of the shelves through an opening is blocked and (2) another position in which the rear sides of the shelving units are separated which facilitates placement of merchandise onto rear ends of at least one of the shelving units; and loading at least one of the shelving units from the rear side with fresh merchandise.

* * * * *